US012349806B1

(12) United States Patent
Wang

(10) Patent No.: US 12,349,806 B1
(45) Date of Patent: Jul. 8, 2025

(54) ROTATING AND ROCKING STRUCTURE AND FOLDABLE CHAIR HAVING THE STRUCTURE

(71) Applicant: Xiamen Zhengchuangyou Trading Co., Ltd, Xiamen (CN)

(72) Inventor: Li Ii Wang, Xiamen (CN)

(73) Assignee: Xiamen Zhengchuangyou Trading Co., Ltd, Xiamen (CN)

( * ) Notice: Subject to any disclaimer, the term of this patent is extended or adjusted under 35 U.S.C. 154(b) by 0 days.

(21) Appl. No.: 19/019,531

(22) Filed: Jan. 14, 2025

(30) Foreign Application Priority Data

Dec. 9, 2024 (CN) ..... 202411802252.6
Dec. 9, 2024 (CN) ..... 202423029291.5

(51) Int. Cl.

| | |
|---|---|
| ***A47C 3/025*** | (2006.01) |
| ***A47C 3/02*** | (2006.01) |
| ***A47C 3/026*** | (2006.01) |
| ***A47C 3/18*** | (2006.01) |
| ***A47C 4/28*** | (2006.01) |
| ***A47C 4/30*** | (2006.01) |
| ***A47C 9/10*** | (2006.01) |

(52) U.S. Cl.
CPC ..... *A47C 3/0255* (2013.01); *A47C 3/02* (2013.01); *A47C 3/025* (2013.01); *A47C 3/026* (2013.01); *A47C 3/18* (2013.01); *A47C 4/286* (2013.01); *A47C 4/30* (2013.01); *A47C 9/10* (2013.01)

(58) Field of Classification Search
CPC ..... A47C 3/0255; A47C 3/02; A47C 3/025; A47C 3/026; A47C 3/18; A47C 4/286; A47C 4/30; A47C 9/10
USPC ..... 297/16.2, 32, 258.1, 259.1, 270.1–270.3
See application file for complete search history.

(56) References Cited

U.S. PATENT DOCUMENTS

| | | | | |
|---|---|---|---|---|
| 5,653,505 | A * | 8/1997 | Holobaugh, Jr. .... | A47C 3/0255 297/273 |
| 11,871,848 | B1 * | 1/2024 | Wang ..... | A47C 4/286 |
| 11,980,292 | B1 * | 5/2024 | Wang ..... | A47C 1/03261 |
| 2019/0208910 | A1 * | 7/2019 | Sugano ..... | A47C 3/18 |
| 2020/0315355 | A1 * | 10/2020 | Shibamoto ..... | A47C 3/40 |
| 2021/0112988 | A1 * | 4/2021 | Yajima ..... | A47C 9/002 |
| 2023/0363537 | A1 * | 11/2023 | Serena ..... | A47C 1/03255 |
| 2024/0382001 | A1 * | 11/2024 | Letow ..... | A47C 3/026 |

* cited by examiner

*Primary Examiner* — Robert Canfield
(74) *Attorney, Agent, or Firm* — Jose Cherson Weissbrot

(57) ABSTRACT

A rotating and rocking structure and a foldable chair having the structure are provided. The rotating and rocking structure includes an upper assembly, a base, and a rocking assembly, where the base is pivotally mounted on one or more rotating shafts at one or a plurality of ends of the rocking assembly, and the upper assembly is pivotally mounted on one or more rotating shafts at one or a plurality of ends of the rocking assembly. The rotating and rocking structure adopts the rocking assembly, and the upper assembly and the base are respectively installed at the two ends of the rocking assembly. The upper assembly can rock relative to the base, thereby realizing the rocking function. The rocking assembly includes a front rocking element and a rear rocking element respectively installed at the front and rear ends of the base and the upper assembly.

17 Claims, 17 Drawing Sheets

ROTATING AND ROCKING STRUCTURE AND FOLDABLE CHAIR HAVING THE STRUCTURE

CROSS REFERENCE TO THE RELATED APPLICATIONS

This application is based upon and claims priority to Chinese Patent Applications No. 2024118022526 and No. 2024230292915, both filed on Dec. 9, 2024, the entire contents of which are incorporated herein by reference.

TECHNICAL FIELD

The present invention relates to the technical field of leisure products, and particularly to a rotating and rocking structure and a foldable chair having the structure.

BACKGROUND

Outdoor activities, such as fishing and camping, usually require articles like portable tables and chairs. But in some application scenarios or places for rest, the rotating or rocking function is more attractive. It is difficult for existing foldable chairs to integrate both rotating and rocking functions. In addition, the rocking structure of existing foldable chairs adopts a deflection mechanism, resulting in large resistance during a rocking process and greatly reduced comfort. Moreover, the deflection mechanism is prone to displacement or getting stuck during the rocking process, further affecting a user's experience of rocking.

SUMMARY

In view of this, it is necessary to provide a rotating and rocking structure to solve the above technical problems, thus realizing the integration of rotating and rocking functions, with a high degree of freedom and excellent flexibility during rocking, and without displacement or getting stuck, thereby greatly improving the user experience.

To achieve the above objective, the present application provides a rotating and rocking structure, including an upper assembly, a base, and a rocking assembly, the base is pivotally mounted on one or more rotating shafts at one or a plurality of ends of the rocking assembly, and the upper assembly is pivotally mounted on one or more rotating shafts at one or a plurality of ends of the rocking assembly.

Further, the rocking assembly includes a front rocking element and a rear rocking element, the front end of the base is pivotally mounted on a first rotating shaft at the upper end of the front rocking element through a first pivot shaft, the front end of the upper assembly is pivotally mounted on a second rotating shaft at the lower end of the front rocking element through a first pivot member, the rear end of the base is pivotally mounted on a third rotating shaft at the upper end of the rear rocking element through a second pivot shaft, and the rear end of the upper assembly is pivotally mounted on a fourth rotating shaft at the lower end of the rear rocking element through a second pivot member.

Further, the front rocking element includes two front rocking sheets arranged opposite to each other and a front connecting sheet vertically arranged between the two front rocking sheets, each front rocking sheet includes a first runway-like main piece body and an irregular side piece extending from an edge of the first runway-like main piece body, the other side of the irregular side piece is connected to the front connecting sheet, and the distance from one side of the irregular side piece to the side of the first runway-like main piece body gradually increases from top to bottom.

Further, the rear rocking element includes two rear rocking sheets arranged opposite to each other and a rear connecting sheet vertically arranged between the two rear rocking sheets, each rear rocking sheet includes a second runway-like main piece body, and the rear connecting sheet is connected to the second runway-like main piece body.

Further, the base is provided with a first limiting portion for limiting the pivoting angle of the front rocking element, thereby limiting a first angle of the front rocking element pivoting relative to the base.

Further, the base is provided with a second limiting portion for limiting the pivoting angle of the rear rocking element, thereby limiting a second angle of the rear rocking element pivoting relative to the base.

Further, the base includes two side panels arranged opposite to each other, the front end of each side panel protrudes forward to form a front protruding portion, and the rear end of each side panel protrudes backward to form a rear protruding portion, the two ends of the first pivot shaft are respectively rotatably connected to the front protruding portions of the two side panels and are pivotally connected to the upper end of the front rocking element, the two ends of the second pivot shaft are respectively rotatably connected to the rear protruding portions of the two side panels and are pivotally connected to the upper end of the rear rocking element, the base also includes a bottom, the bottom and the two side panels enclose an accommodating space, the part of the bottom close to the front rocking element concaves inward to form the first limiting portion, and the part of the bottom close to the rear rocking element concaves inward to form the second limiting portion.

Further, an elastic piece is also included, one end of the elastic piece is engaged with the bottom, the elastic piece is bent around the first pivot shaft, the other end of the elastic piece is within the movement trajectory of the front connecting sheet of the front rocking element. When the front connecting sheet moves to a position close to the first limiting portion, the front connecting sheet abuts against the other end of the elastic piece.

Further, a lower assembly is also included, the upper assembly, the base, and the lower assembly are rotatably connected via a first rotating assembly.

Further, the first rotating assembly includes a first bearing, a central shaft, and a second bearing. The central shaft passes through the upper assembly, the base, and the lower assembly. The first bearing is sleeved on the central shaft and arranged between the upper assembly and the base, and the second bearing is sleeved on the central shaft and arranged between the base and the lower assembly.

Further, the two ends of the central shaft are provided with limiting components that are respectively engaged with the upper assembly and the lower assembly and configured for limiting the radial movement of the central shaft.

To achieve the above objective, the present application provides another rotating and rocking structure, the rotating and rocking structure includes an upper assembly, a base, and a rocking assembly, the base is pivotally mounted on a first rotating shaft at a first end of the rocking assembly, and the upper assembly is pivotally mounted on a second rotating shaft at a second end of the rocking assembly. Further, the front rocking element includes a front rocking sheet and a front connecting sheet vertically and transversely arranged on the front rocking sheet, the front end of the base is pivotally installed on the first rotating shaft at the upper end of the front rocking sheet through a first pivot shaft, the front connecting sheet has front bending portions bent toward the base at both ends, and the front end of the upper assembly is pivotally installed on the second rotating shaft of the front bending portion of the front connecting sheet through a first pivot member; the rear rocking element includes a rear rocking sheet and a rear connecting sheet vertically and transversely arranged on the rear rocking sheet, the rear end of the base is pivotally installed on a third rotating shaft at the upper end of the rear rocking sheet through a second pivot shaft, the rear connecting sheet has rear bending portions bent toward the base at both ends, and the rear end of the upper assembly is pivotally installed on a fourth rotating shaft of the rear bending portion of the rear connecting sheet through a second pivot member.

Further, the base is provided with a first limiting portion for limiting the pivoting angle of the front rocking element, thereby limiting a first angle of the front rocking element pivoting relative to the base; the base is provided with a second limiting portion for limiting the pivoting angle of the rear rocking element, thereby limiting a second angle of the rear rocking element pivoting relative to the base.

Further, the front connecting sheet is provided with a front buffer portion corresponding to the first limiting portion, and the rear connecting sheet is provided with a rear buffer portion corresponding to the second limiting portion.

Further, the base includes two side panels arranged opposite to each other, the front end of each side panel protrudes forward to form a front protruding portion, and the rear end of each side panel protrudes backward to form a rear protruding portion, the two ends of the first pivot shaft are respectively rotatably connected to the front protruding portions of the two side panels and are pivotally connected to the upper end of the front rocking element, the two ends of the second pivot shaft are respectively rotatably connected to the rear protruding portions of the two side panels and are pivotally connected to the upper end of the rear rocking element, the base also includes a bottom, the bottom and the two side panels enclose an accommodating space, the part of the bottom close to the front rocking element concaves inward to form the first limiting portion, and the part of the bottom close to the rear rocking element concaves inward to form the second limiting portion, the base also includes a cover plate, and the cover plate is provided with a concave surface.

Further, an elastic piece is also included, one end of the elastic piece is engaged with the bottom, the elastic piece is bent around the first pivot shaft, the other end of the elastic piece is within the movement trajectory of the front connecting sheet of the front rocking element. When the front connecting sheet moves to a position close to the first limiting portion, the front connecting sheet abuts against the other end of the elastic piece.

Further, the bottom is provided with a front fallback space facilitating the rotation of the front rocking sheet and a rear fallback space facilitating the rotation of the rear rocking sheet.

To achieve the above objective, the present application further provides a foldable chair capable of rotating and rocking. The foldable chair has the rotating and rocking structure as described above. The foldable chair includes a support arm and a support leg. The upper assembly is provided with an upper receiving groove for receiving the support arm, and the lower assembly is provided with a lower receiving groove for receiving the support leg. The support arm is rotatably connected in the upper receiving groove of the upper assembly through a first rotary shaft. The lower assembly also includes an elastic piece assembly, and the elastic piece assembly includes a first elastic piece and a second elastic piece. The first elastic piece and the second elastic piece are cross-stacked and received in a divergent state in the lower receiving groove of the lower assembly. The support leg is rotatably connected in the lower receiving groove of the lower assembly through a second rotary shaft. The elastic piece goes across the second rotary shaft and the end thereof is located on an inner wall of the support leg. Under the action of the elastic piece, the support leg is kept in an outwardly stretched state with the second rotary shaft as a rotating shaft.

Further, a chair cloth is also included, and the chair cloth is detachably mounted on an end of the support arm.

Further, the support leg is a retractable support leg, and the support arm is a retractable support arm.

Distinguishing from the prior art, the above technical solution has the following technical effects:

The rotating and rocking structure of the present invention adopts a rocking assembly, and the upper assembly and the base are respectively installed at the two ends of the rocking assembly. The upper assembly can rock relative to the base by virtue of the free rocking of the rocking assembly, thereby realizing the rocking function.

The rocking assembly of the rotating and rocking structure of the present invention includes a front rocking element and a rear rocking element, which are respectively installed at the front and rear ends of the base and the upper assembly. The interference degree is small during the rocking of the front and rear parts, and the rocking is more flexible.

The rocking assembly of the rotating and rocking structure of the present invention adopts a front rocking element and a rear rocking element with buffer portions thereon, which cooperates with the first limiting portion and the second limiting portion on the base to realize the limit and buffer during the rocking process, further improving the safety and comfort during rocking.

REFERENCE NUMERALS

Figure 1:
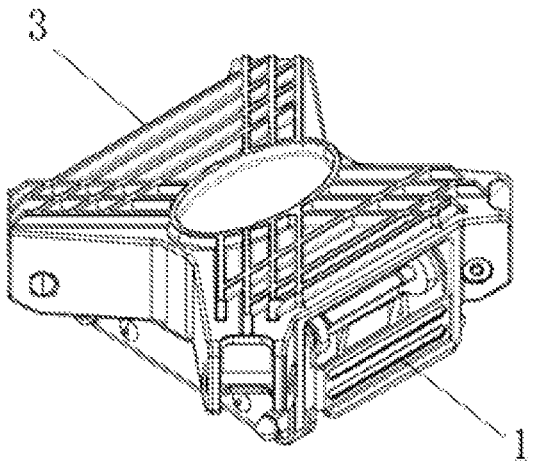
FIG. 1 is a first schematic diagram of the three-dimensional structure of the rotating and rocking structure of Embodiment 1 of the present invention.
Figure 2:
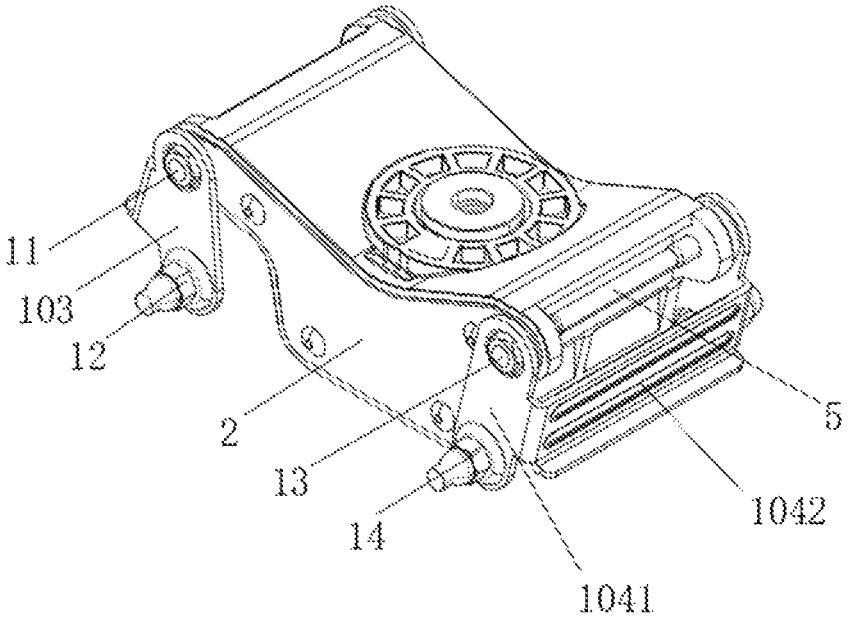
FIG. 2 is a second schematic diagram of the three-dimensional structure of the rotating and rocking structure of Embodiment 1 of the present invention.
Figure 3:
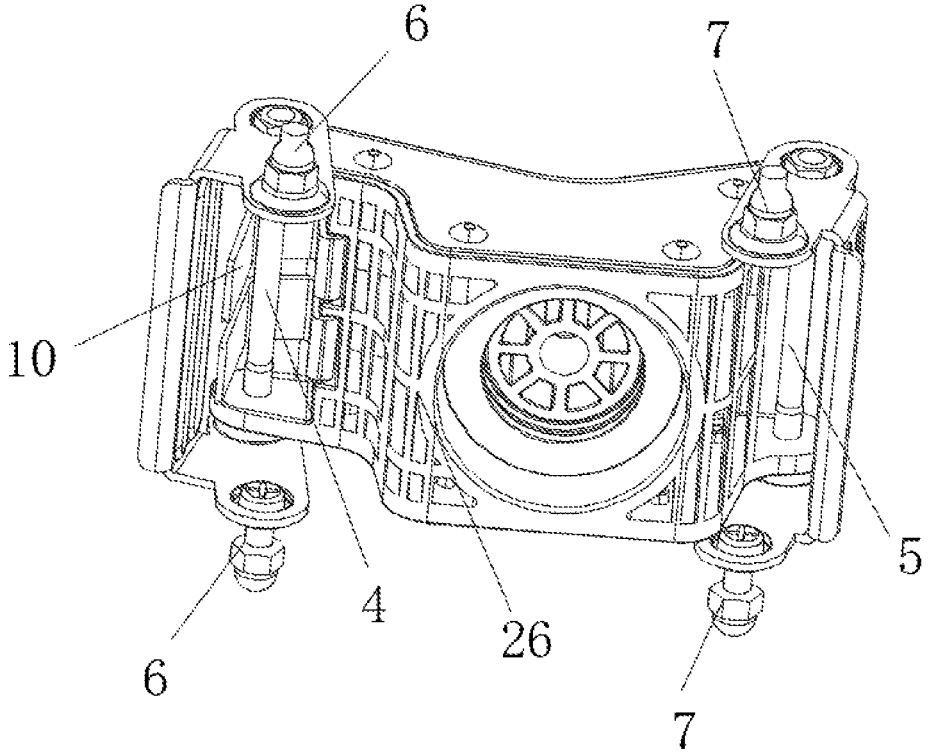
FIG. 3 is a third schematic diagram of the three-dimensional structure of the rotating and rocking structure of Embodiment 1 of the present invention.
Figure 4:
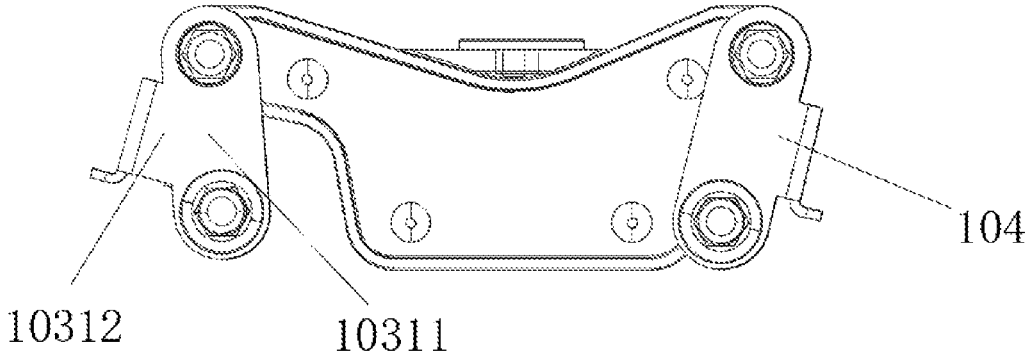
FIG. 4 is a schematic diagram showing the side view of the rotating and rocking structure of Embodiment 1 of the present invention.
Figure 5:
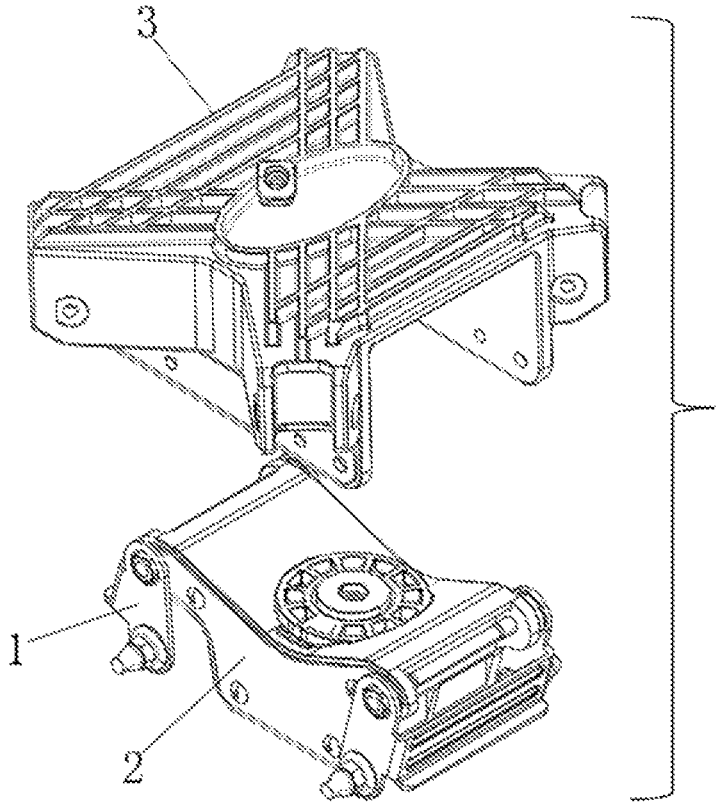
FIG. 5 is a first exploded view showing the rotating and rocking structure of Embodiment 1 of the present invention.
Figure 6:
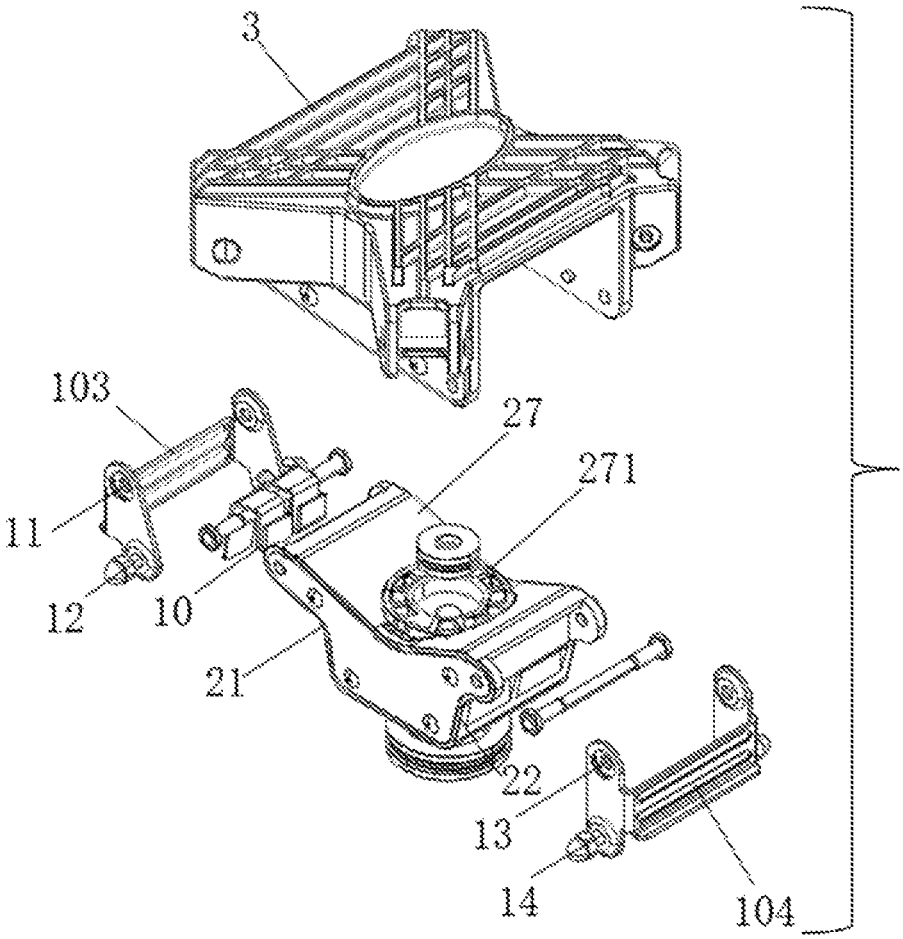
FIG. 6 is a second exploded view showing the rotating and rocking structure of Embodiment 1 of the present invention.
Figure 7:
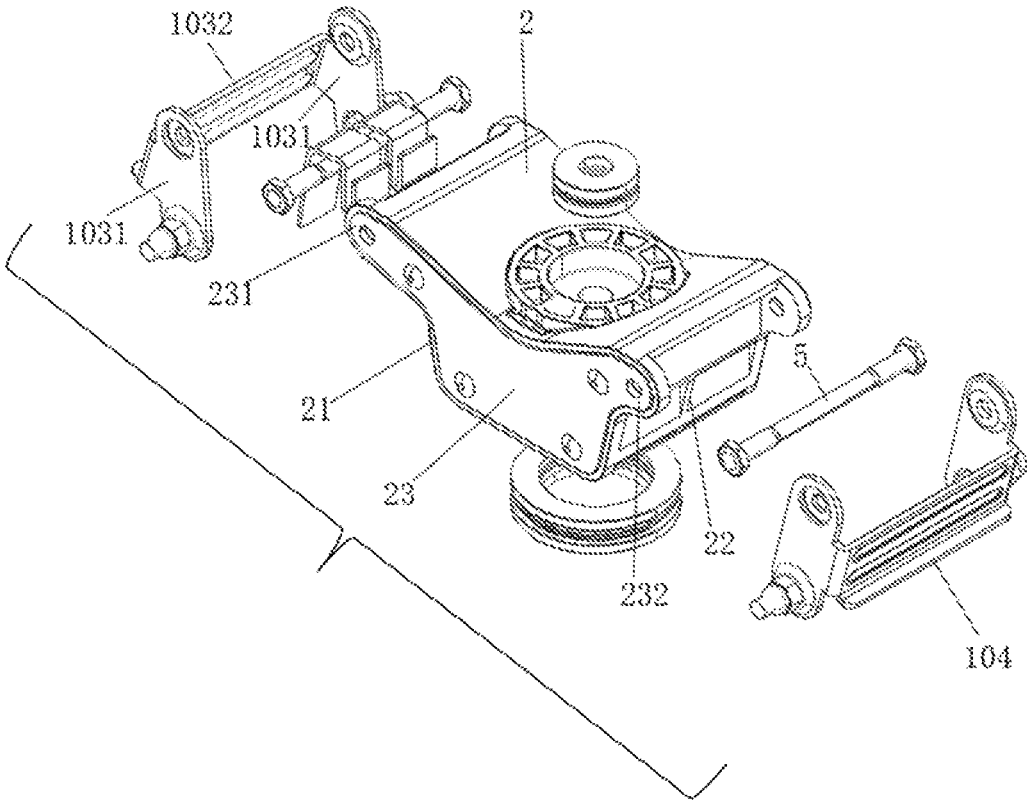
FIG. 7 is a third exploded view showing the rotating and rocking structure of Embodiment 1 of the present invention.
Figure 8:
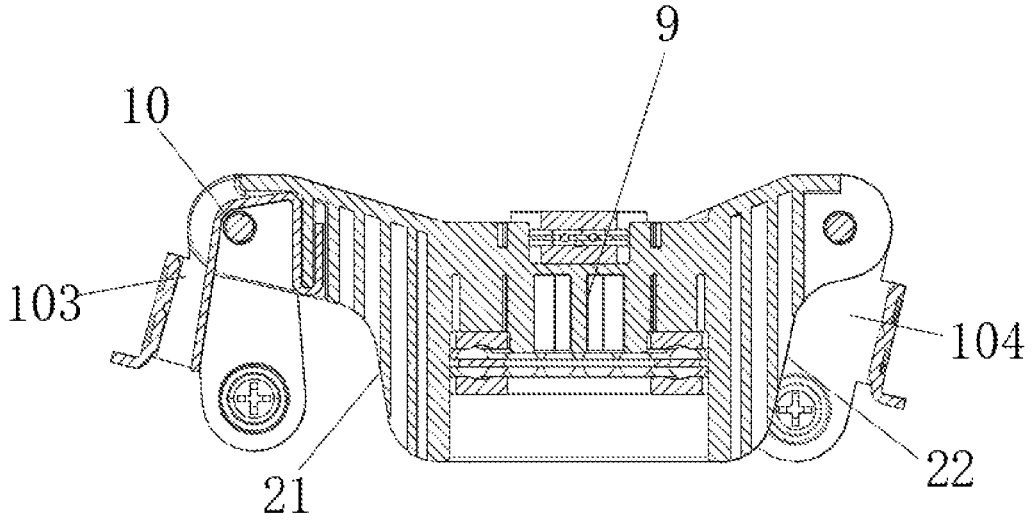
FIG. 8 is a first cross-sectional view of the rotating and rocking structure of Embodiment 1 of the present invention.
Figure 9:
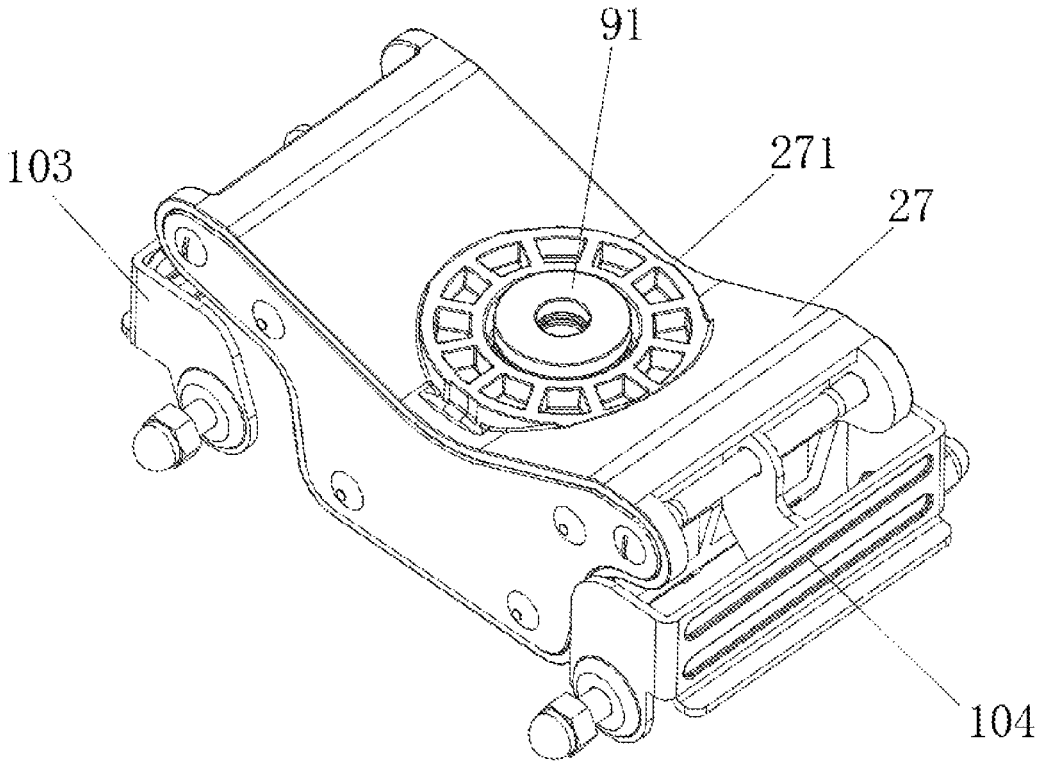
FIG. 9 is a first schematic diagram of the three-dimensional structure of the rotating and rocking structure of Embodiment 2 of the present invention.
Figure 10:
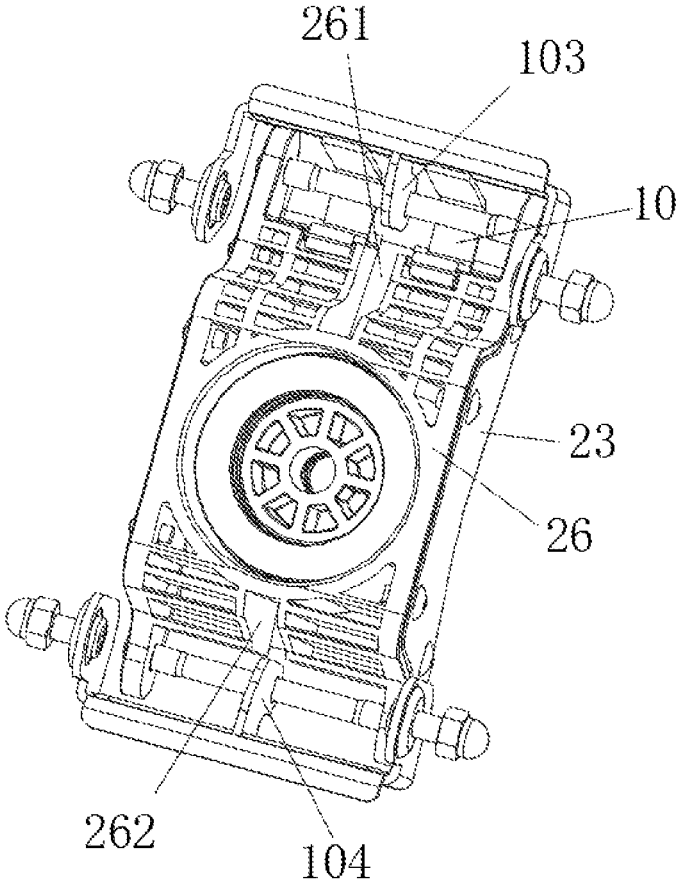
FIG. 10 is a second schematic diagram of the three-dimensional structure of the rotating and rocking structure of Embodiment 2 of the present invention.
Figure 11:
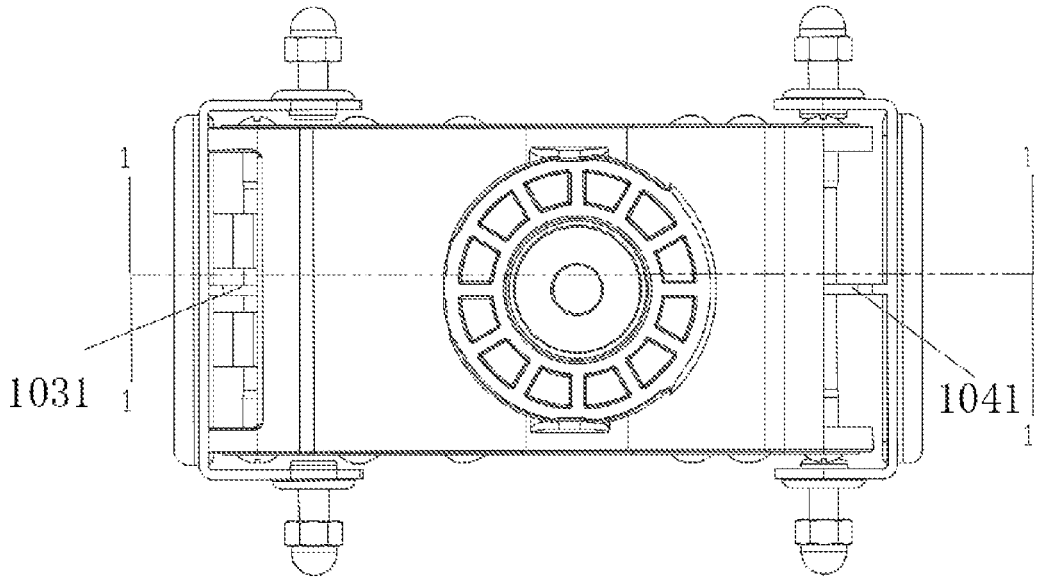
FIG. 11 is a third schematic diagram of the three-dimensional structure of the rotating and rocking structure of Embodiment 2 of the present invention.
Figure 12:
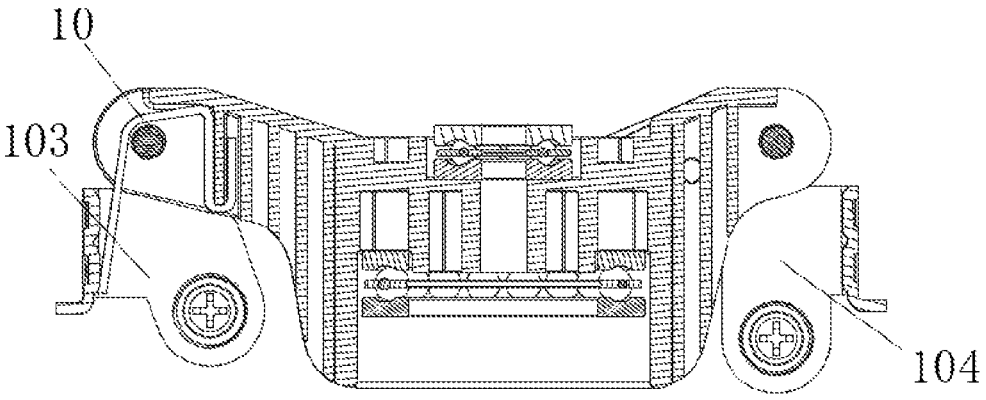
FIG. 12 is a cross-sectional view of FIG. 10.
Figure 13:
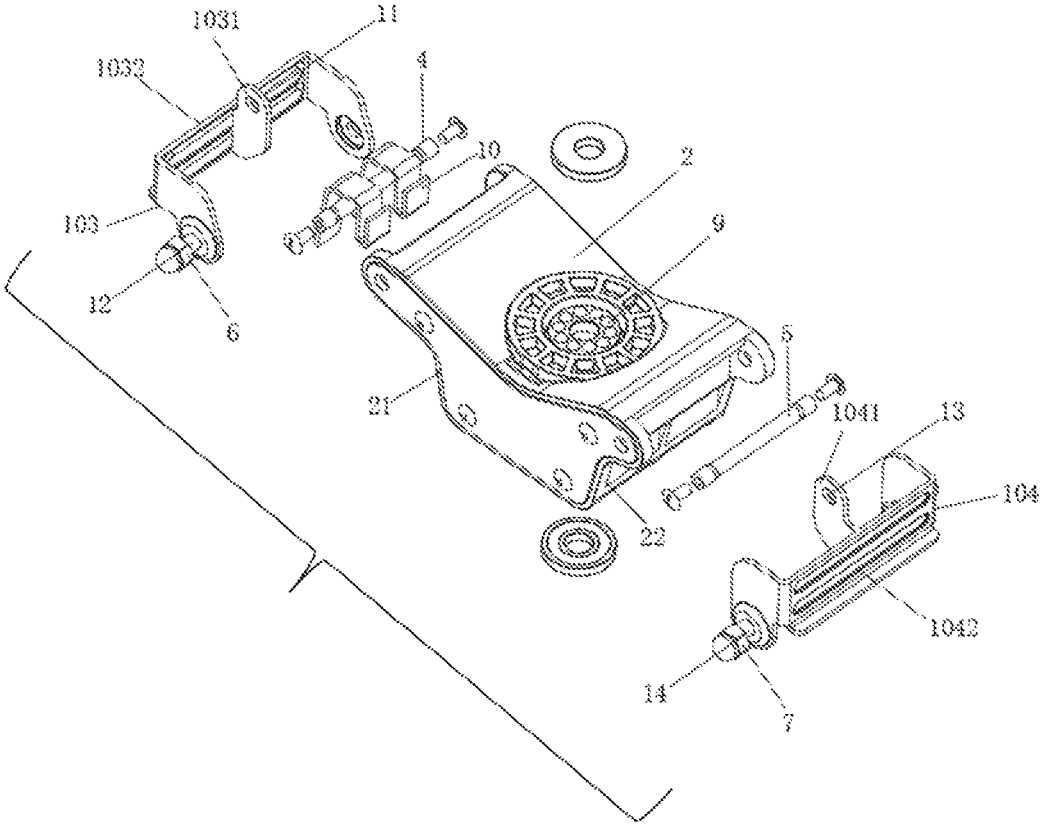
FIG. 13 is a first exploded view of the rotating and rocking structure of Embodiment 2 of the present invention.

1 rocking assembly; 11 first rotating shaft; 12 second rotating shaft; 13 third rotating shaft; 14 fourth rotating shaft; 103 front rocking element; 1031 front rocking sheet; 10311 first runway-like main piece body; 10312 irregular side piece; 1032 front connecting sheet; 104 rear rocking element; 1041 rear rocking sheet; 1042 rear connecting sheet; 2 base; 21 first limiting portion; 22 second limiting portion; 23 side panel; 231 front protruding portion; 232 rear protruding portion; 26 bottom; 261 front fallback space; 262 rear fallback space; 27 cover plate; 3 upper assembly; 31 upper receiving groove; 4 first pivot shaft; 5 second pivot shaft; 6 first pivot member; 7 second pivot member; 8 lower assembly; 81 lower receiving groove; 9 first rotating assembly; 91 first bearing; 92 central shaft; 93 second bearing; 10 elastic piece; 15 elastic piece assembly; 151 first elastic piece; 152 second elastic piece; 16 support arm; 17 support leg; 18 first rotary shaft; 19 second rotary shaft.

DETAILED DESCRIPTION OF THE EMBODIMENTS

In order to explain the technical content, structural features, achieved objectives and effects of the technical solution in detail, the following is a detailed description in conjunction with specific embodiments and accompanying drawings.

In the present invention, "embodiment" mentioned means that the specific features, structures, or characteristics described in conjunction with the embodiment may be included in at least one embodiment of the present invention. The word "embodiment" appearing in various parts of the specification does not necessarily refer to the same embodiment, nor does it particularly limit its independence or association with other embodiments. In principle, in the present invention, as long as there is no technical contradiction or conflict, the various technical features mentioned in each embodiment can be combined in any way to form a corresponding implementable technical solution.

Unless otherwise defined, the technical terms used herein have the same meanings as those generally understood by those skilled in the art to which the present invention belongs; the use of relevant terms herein is only for describing specific embodiments and is not intended to limit the present invention.

In the description of the present invention, the term "and/or" is an expression used to describe the logical relationship between objects, indicating that three relationships may exist, for example, A and/or B means: A exists, B exists, and A and B exist at the same time. In addition, the character "/" in the present invention generally indicates that the objects before and after are in a logical relationship of "or".

In the present invention, the terms such as "first", "second", and the like are merely used to distinguish one entity or operation from another entity or operation, and do not necessarily require or imply any actual relationship of quantity, priority, or sequence among these entities or operations.

Without further restrictions, in the present invention, the words "include(s)", "comprise(s)", "have/has", or other similar open-ended expressions used in sentences are intended to cover non-exclusive inclusion. These expressions do not exclude the presence of additional elements in the process, method, or product including the elements, so that the process, method, or product including a series of elements may include not only those limited elements, but also other elements not explicitly listed, or also include elements inherent to such process, method, or product.

Similar to the understanding in the Examination Guidelines, in the present invention, the expressions such as "greater than", "less than", "exceed", and the like are understood to exclude the number itself; the expressions such as "above", "below", "within", and the like are understood to include the number itself. In addition, in the description of the embodiments of the present invention, the meaning of "a/the plurality of/multiple" is more than two (including two), and similar expressions related to "a/the plurality of/multiple" are also understood in this way, such as "a/the plurality of/multiple groups", "a/the plurality of/multiple times", etc., unless otherwise clearly and specifically limited.

In the description of the embodiments of the present invention, the space-related expressions used, such as "center", "longitudinal", "lateral", "length", "width", "thickness", "up", "down", "front", "back", "left", "right", "vertical", "horizontal", "perpendicular", "top", "bottom", "inside", "outside", "clockwise", "counterclockwise", "axial", "radial", "circumferential", etc., indicate the orientation or position relationship based on the orientation or position relationship shown in the specific embodiments or drawings, and are only for the convenience of describing the specific embodiments of the present invention or facilitating the reader's understanding, but do not indicate or imply that the referred device or component must have a specific position, a specific orientation, or be constructed or operated in a specific orientation, and therefore cannot be understood as a limitation on the embodiments of the present invention.

Unless otherwise expressly specified or limited, in the description of the embodiments of the present invention, the terms such as "install/mount", "link", "connect", "fix", "set/provide/arrange", and the like used should be understood in a broad sense. For example, the "connection" can be a fixed connection, a detachable connection, or an integrated setting; it can be a mechanical connection, an electrical connection, or a communication connection; it can be a direct connection, or an indirect connection through an intermediate medium; it can be an internal communication between two elements or an interaction relationship between two elements. For those skilled in the art to which the present invention belongs, the specific meanings of the above terms in the embodiments of the present invention can be understood according to the specific circumstances.

Embodiment 1

Referring to FIG. 1 to FIG. 7, Embodiment 1 of the present invention provides a rotating and rocking structure, including an upper assembly 3, a base 2, a rocking assembly 1, and a lower assembly 8, where the upper assembly 3, the base 2, and the lower assembly 8 are rotatably connected via a first rotating assembly 9.

The base 2 is pivotally mounted on one or more first rotating shafts 11 at one or a plurality of ends of the rocking assembly 1, and the upper assembly 3 is pivotally mounted on one or more second rotating shafts 12 at one or a plurality of ends of the rocking assembly 1. The plurality of ends refers to two ends and more than two ends. The base 2 can be pivotally mounted on one rotating shaft at one end of the rocking assembly 1, or the base 2 is pivotally mounted on two rotating shafts corresponding to two ends of the rocking assembly 1, or the base 2 is pivotally mounted on three or more rotating shafts corresponding to three or more ends of the rocking assembly 1. The position and number of the rotating shafts are matched with the position and number of the ends. Similarly, the upper assembly 3 can also be pivotally mounted on one or more rotating shafts 12 at one or more ends of the rocking assembly 1, the configuration of which is similar to the configuration of the position and number of the base 2 and the ends of the rocking assembly 1 as well as the rotating shafts.

Specifically, in the present embodiment, the rocking assembly 1 includes a front rocking element 103 and a rear rocking element 104, the front rocking element 103 includes two front rocking sheets 1031 arranged opposite to each other and a front connecting sheet 1032 vertically arranged between the two front rocking sheets 1031, each front rocking sheet 1031 includes a first runway-like main piece body 10311 and an irregular side piece 10312 extending from an edge of the first runway-like main piece body, the other side of the irregular side piece 10312 is connected to the front connecting sheet 1032, and the distance from one side of the irregular side piece 10312 to the side of the first runway-like main piece body 10311 gradually increases from top to bottom. From the figures, the irregular side piece 10312 is in an approximate triangle or trapezoid shape, with its surface area gradually increasing from top to bottom and fitting between the first runway-like main piece body 10311 and the front connecting sheet 1032. This design enables the entire rocking assembly 1 to have a larger angle during rotation and greatly enhanced rocking amplitude.

The rear rocking element 104 includes two rear rocking sheets 1041 arranged opposite to each other and a rear connecting sheet 1042 vertically arranged between the two rear rocking sheets, each rear rocking sheet 1041 includes a second runway-like main piece body, and the rear connecting sheet 1042 is connected to the second runway-like main piece body.

The front end of the base 2 is pivotally mounted on the first rotating shaft 11 at the upper end of the front rocking element through a first pivot shaft 4, the upper assembly 3 includes an inverted U-shaped connecting portion, the front end of the upper assembly 3, that is, the front end of the inverted U-shaped connecting portion, is pivotally mounted on the second rotating shaft 12 at the lower end of the front rocking element through a first pivot member 6, the rear end of the base 2 is pivotally mounted on a third rotating shaft 13 at the upper end of the rear rocking element 104 through a second pivot shaft 5, and the rear end of the upper assembly 3 is pivotally mounted on a fourth rotating shaft 14 at the lower end of the rear rocking element 104 through a second pivot member 7.

In the present embodiment, the base 2 is provided with a first limiting portion 21 for limiting the pivoting angle of the front rocking element 103, thereby limiting a first angle of the front rocking element 103 pivoting relative to the base. The base 2 is provided with a second limiting portion 22 for limiting the pivoting angle of the rear rocking element 104, thereby limiting a second angle of the rear rocking element 104 pivoting relative to the base 2. Specifically, the base 2 includes two side panels 23 arranged opposite to each other, the front end of each side panel 23 protrudes forward to form a front protruding portion 231, and the rear end of each side panel 23 protrudes backward to form a rear protruding portion 232, the two ends of the first pivot shaft 4 are respectively rotatably connected to the front protruding portions 231 of the two side panels and are pivotally connected to the upper end of the front rocking element 103, the two ends of the second pivot shaft 5 are respectively rotatably connected to the rear protruding portions 232 of the two side panels 23 and are pivotally connected to the upper end of the rear rocking element 104, the base 2 also includes a bottom 26, the bottom 26 and the two side panels enclose an accommodating space, the part of the bottom close to the front rocking element concaves inward to form the first limiting portion 21, and the part of the bottom close to the rear rocking element concaves inward to form the second limiting portion 22. The base also includes a cover plate 27, the cover plate 27 is provided with a concave surface 271, a circular mounting lid is provided in the middle area of the concave surface 271, and reinforcing ribs are provided on the circular mounting lid to enhance the stability of the entire rotating and rocking structure during the rocking process.

To smoothly reset during the rocking process, save the external force during the rocking process, and improve the degree of freedom and effect of rocking, the rotating and rocking structure in Embodiment 1 further includes an elastic piece 10, one end of the elastic piece 10 has a U-shaped groove engaged with the bottom, the elastic piece 10 is bent around the first pivot shaft, the other end of the elastic piece 10 is within the movement trajectory of the front connecting sheet of the front rocking element 103. When the front connecting sheet 1032 moves to a position close to the first limiting portion 21, the front connecting sheet 1032 abuts against the other end of the elastic piece 10. Under the elastic force of the elastic piece 10, the front connecting sheet 1032 will move in a direction away from the first limiting portion 21, thereby driving the rear connecting sheet 1042 on the other side to move accordingly to achieve the effect of repeated rocking.

The first rotating assembly 9 includes a first bearing 91, a central shaft 92, and a second bearing 93. The central shaft 92 passes through the upper assembly, the base 2, and the lower assembly 8. The first bearing 91 is a flat bearing, which is sleeved on the central shaft and arranged between the upper assembly 3 and the base 2 to realize the relative rotation of the upper assembly 3 and the base 2. In the present embodiment, the first bearing 91 is located in a hollow area in the middle of the circular mounting lid; the second bearing 93 is sleeved on the central shaft 92 and arranged between the base 2 and the lower assembly 8. The two ends of the central shaft 92 are provided with limiting components for limiting the radial movement of the central shaft, and the limiting components are respectively engaged with the upper assembly and the lower assembly. In Embodiment 1, the limiting component at the upper end of the central shaft 92 is a protrusion fixedly arranged at the top of the central shaft 92, and the limiting component at the lower end of the central shaft 92 is a nut, which is located outside the lower end of the lower assembly 8 and screwed with the protruding central shaft 92 to play a limiting role.

Embodiment 2

Referring to FIG. 9 to FIG. 17, the rotating and rocking structure in Embodiment 2 has a base 2, an upper assembly 3, and a lower assembly 8 that are the same as the base 2, the upper assembly 3, and the lower assembly 8 of Embodiment 1, but a rocking assembly 1 different from that of Embodiment 1. In the present embodiment, the rocking assembly 1 also includes a front rocking element 103 and a rear rocking element 104, and the front end of the base 2 is pivotally installed on the first rotating shaft at the upper end of the front rocking element 103 through the first pivot shaft 4. Specifically, the front rocking element 103 includes a front rocking sheet 1031 and a front connecting sheet 1032 vertically and transversely arranged on the front rocking sheet 1031, and the front end of the base 2 is pivotally installed on the first rotating shaft 11 at the upper end of the front rocking sheet through the first pivot shaft 4.

The front end of the upper assembly 3 is pivotally mounted on the second rotating shaft 12 at the lower end of the front rocking element 103 through the first pivot member 6, the rear end of the base 2 is pivotally mounted on the third rotating shaft 13 at the upper end of the rear rocking element 104 through the second pivot shaft 5, and the rear end of the upper assembly 3 is pivotally mounted on the fourth rotating shaft 14 at the lower end of the rear rocking element 104 through the second pivot member 7.

Specifically, in the present embodiment, the front connecting sheet 1032 has front bending portions bent toward the base at both ends, and the front end of the upper assembly 3 is pivotally installed on the second rotating shaft 12 of the front bending portion of the front connecting sheet through the first pivot member 6; the rear rocking element 104 includes a rear rocking sheet 1041 and a rear connecting sheet 1042 vertically and transversely arranged on the rear rocking sheet, the rear end of the base 2 is pivotally installed on the third rotating shaft 13 at the upper end of the rear rocking sheet 104 through the second pivot shaft 5, the rear connecting sheet 1042 has rear bending portions bent toward the base 2 at both ends, and the rear end of the upper assembly 3 is pivotally installed on the fourth rotating shaft 14 of the rear bending portion of the rear connecting sheet 1042 through the second pivot member 7.

In the present embodiment, the base 2 is provided with a first limiting portion 21 for limiting the pivoting angle of the front rocking element 103, thereby limiting a first angle of the front rocking element pivoting relative to the base 2. The base 2 is provided with a second limiting portion 22 for limiting the pivoting angle of the rear rocking element 104, thereby limiting a second angle of the rear rocking element 104 pivoting relative to the base 2.

In the present embodiment, the base 2 includes two side panels 23 arranged opposite to each other, the front end of each side panel 23 protrudes forward to form a front protruding portion 231, and the rear end of each side panel 23 protrudes backward to form a rear protruding portion 232, the two ends of the first pivot shaft 4 are respectively rotatably connected to the front protruding portions 231 of the two side panels and are pivotally connected to the upper end of the front rocking element 103, the two ends of the second pivot shaft 5 are respectively rotatably connected to the rear protruding portions 232 of the two side panels 23 and are pivotally connected to the upper end of the rear rocking element 104, the base 2 also includes a bottom 26, the bottom 26 and the two side panels enclose an accommodating space, the part of the bottom 26 close to the front rocking element 103 concaves inward to form the first limiting portion 21, and the part of the bottom 26 close to the rear rocking element concaves inward to form the second limiting portion 22.

In the present embodiment, an elastic piece 10 is further included, one end of the elastic piece 10 is engaged with the bottom 26, the elastic piece 10 is bent around the first pivot shaft, the other end of the elastic piece 10 is within the movement trajectory of the front connecting sheet 1032 of the front rocking element 103. When the front connecting sheet 1032 moves to a position close to the first limiting portion, the front connecting sheet 1032 abuts against the other end of the elastic piece 10.

In the present embodiment, the bottom 26 is provided with a front fallback space 261 facilitating the rotation of the front rocking sheet and a rear fallback space 262 facilitating the rotation of the rear rocking sheet.

Embodiment 3

Referring to FIG. 18 to FIG. 23, Embodiment 3 provides a foldable chair capable of rotating and rocking. The foldable chair has the rotating and rocking structure as described in the above Embodiment 1 or Embodiment 2. The foldable chair includes a support arm 16 and a support leg 17. The number of the support arm 16 and the support leg 17 is multiple. In the present embodiment, there are four support arms 16 and four support legs 17. Each support leg 17 is a retractable support leg 17, and each support arm 16 is a retractable support arm. The upper assembly 3 is provided with a plurality of upper receiving grooves 31 for receiving the support arms, and the lower assembly is provided with a plurality of lower receiving grooves for receiving the support legs. The support arm 16 is rotatably connected in the upper receiving groove of the upper assembly through a first rotary shaft 18. The lower assembly also includes an elastic piece assembly 15, and the elastic piece assembly 15 includes a first elastic piece 151 and a second elastic piece 152. The first elastic piece 151 and the second elastic piece 152 are cross-stacked and received in a divergent state in the lower receiving groove 81 of the lower assembly 8. The first elastic piece 151 and the second elastic piece 152 are vertically cross-stacked, and each of the first elastic piece 151 and the second elastic piece 152 has a bending structure that is formed by bending downward from the middle. The support leg 17 is rotatably connected in the lower receiving groove 81 of the lower assembly 8 through a second rotary shaft 19. The first elastic piece 151 and the second elastic piece 152 go across the second rotary shafts 19 and the ends thereof are located on inner walls of the support legs 17.

Under the action of the first elastic piece and the second elastic piece, the support leg 17 is kept in an outwardly stretched state with the second rotary shaft as a rotating shaft.

In the present embodiment, a chair cloth is also included, and the chair cloth is detachably mounted on ends of the support arms 16.

Figure 14:
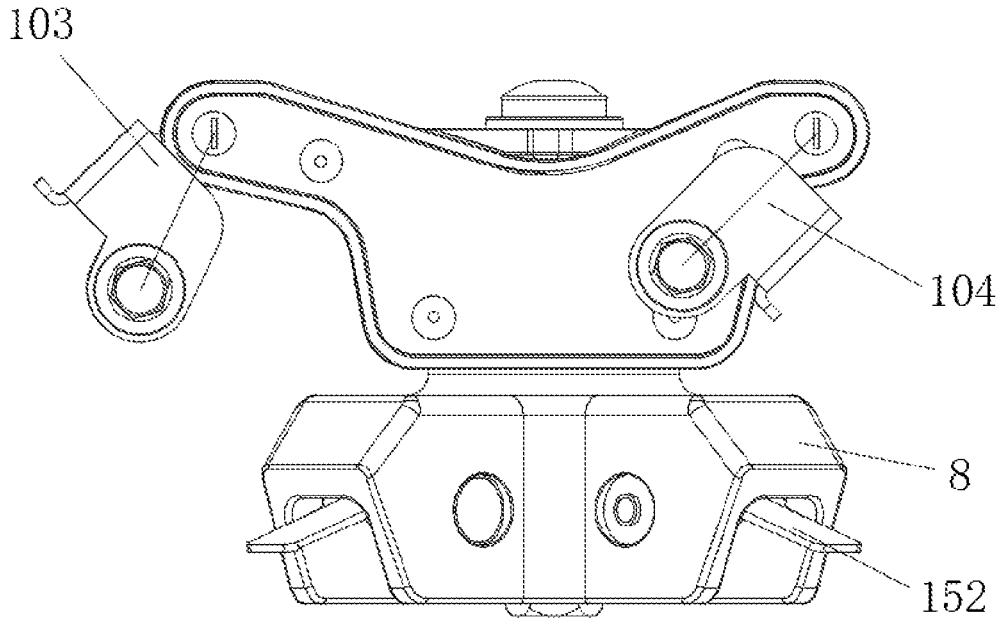
FIG. 14 is a diagram showing the maximum forward rocking amplitude of the rotating and rocking structure of Embodiment 2 of the present invention.
Figure 15:
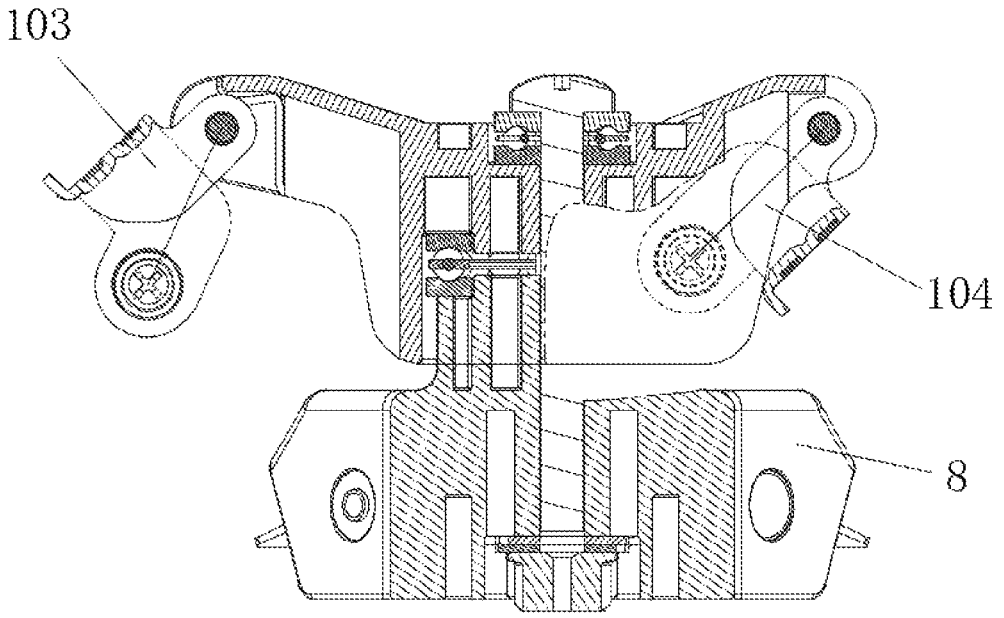
FIG. 15 is a cross-sectional view of FIG. 13.
Figure 16:
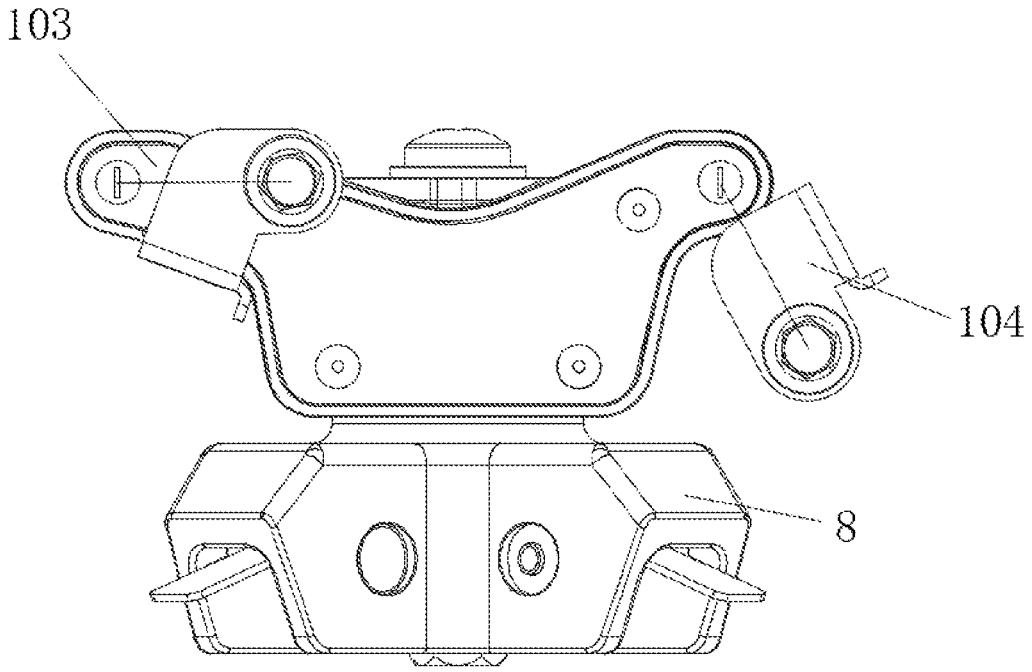
FIG. 16 is a diagram showing the maximum backward rocking amplitude of the rotating and rocking structure of Embodiment 2 of the present invention.
Figure 17:
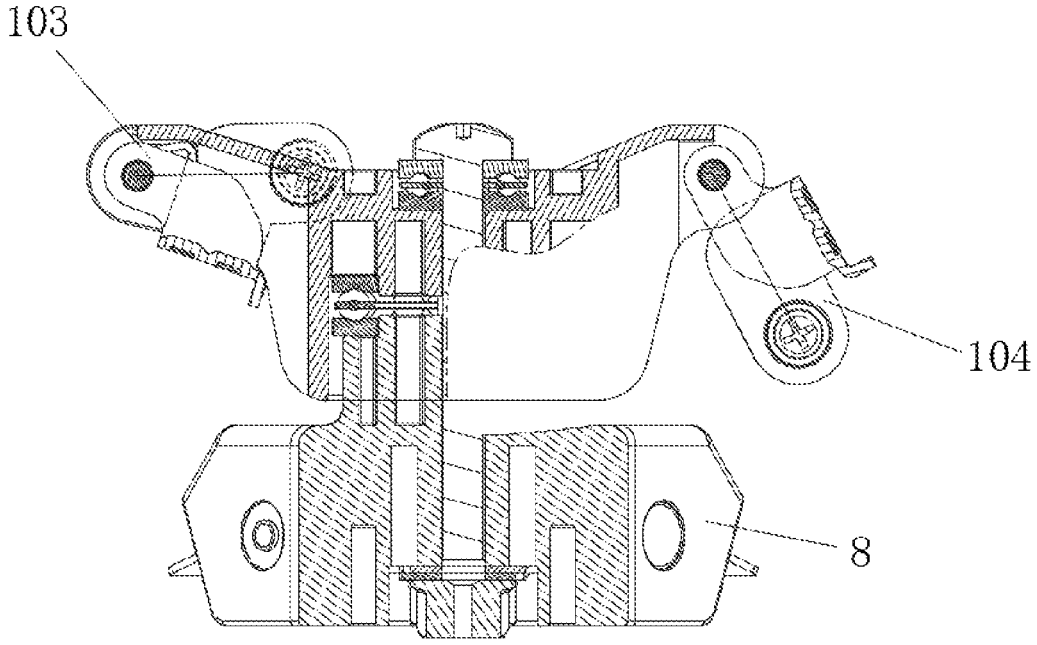
FIG. 17 is a cross-sectional view of FIG. 14.
Figure 18:
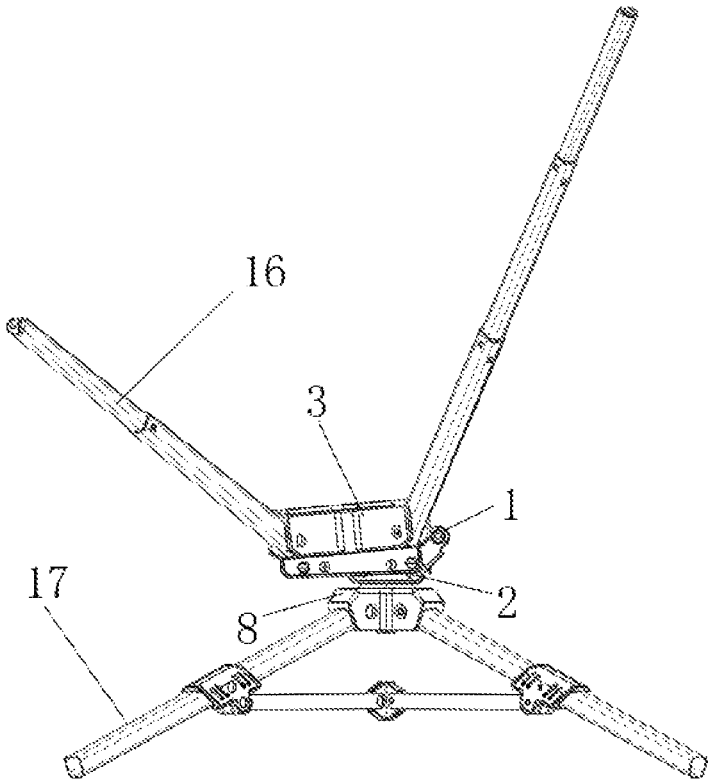
FIG. 18 is a first schematic diagram of the three-dimensional structure of the foldable chair of Embodiment 3 of the present invention.
Figure 19:
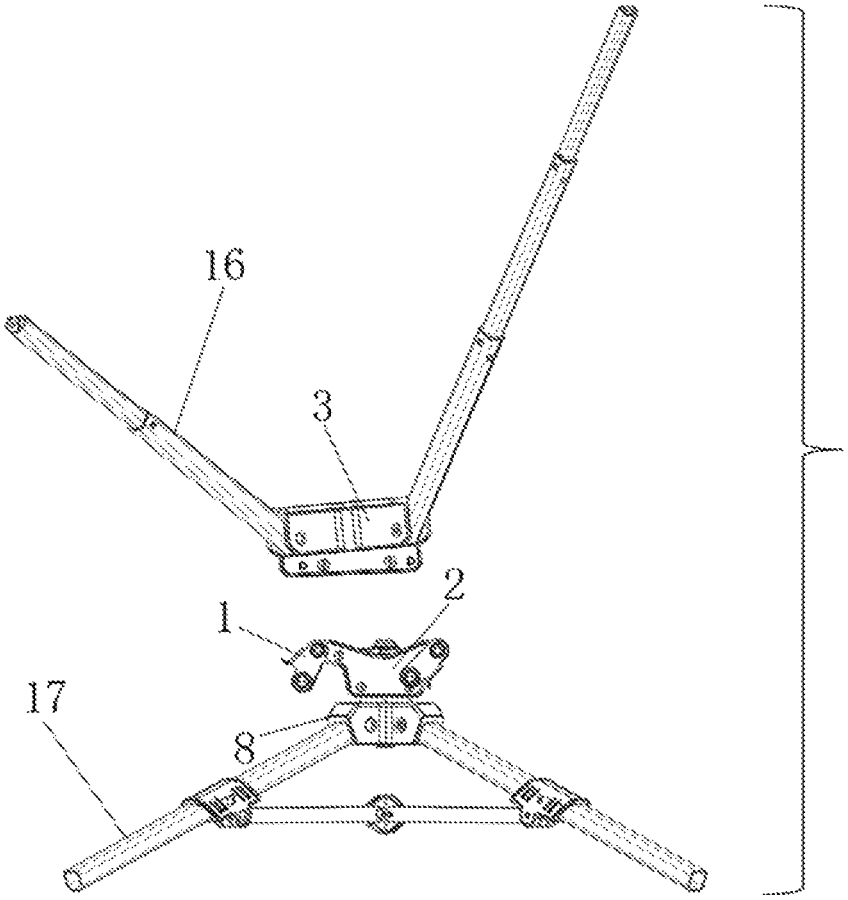
FIG. 19 is a first exploded view of the foldable chair of Embodiment 3 of the present invention.
Figure 20:
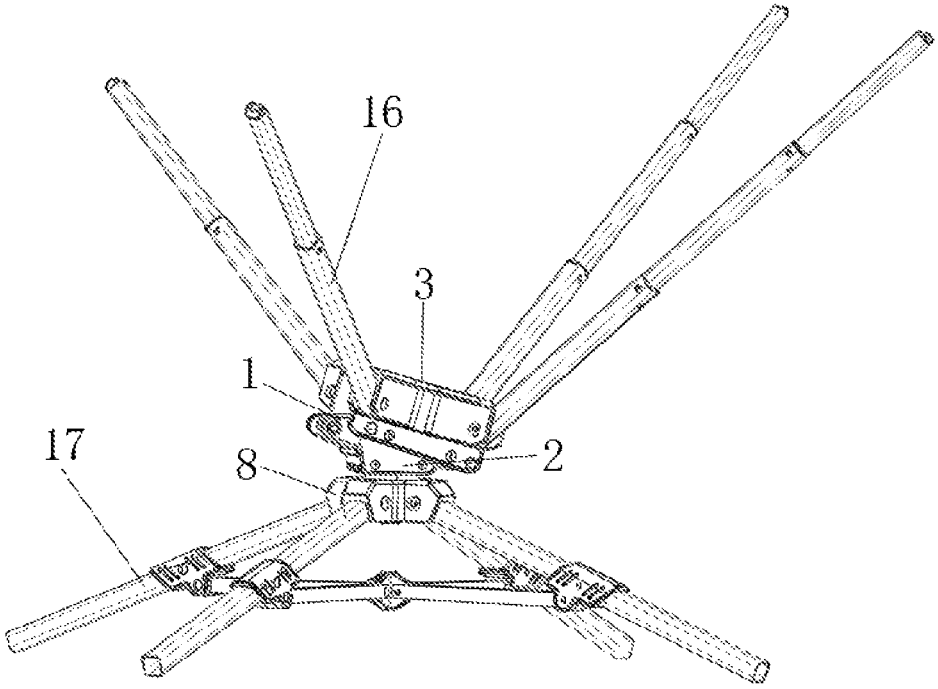
FIG. 20 is a second schematic diagram of the three-dimensional structure of the foldable chair of Embodiment 3 of the present invention.
Figure 21:
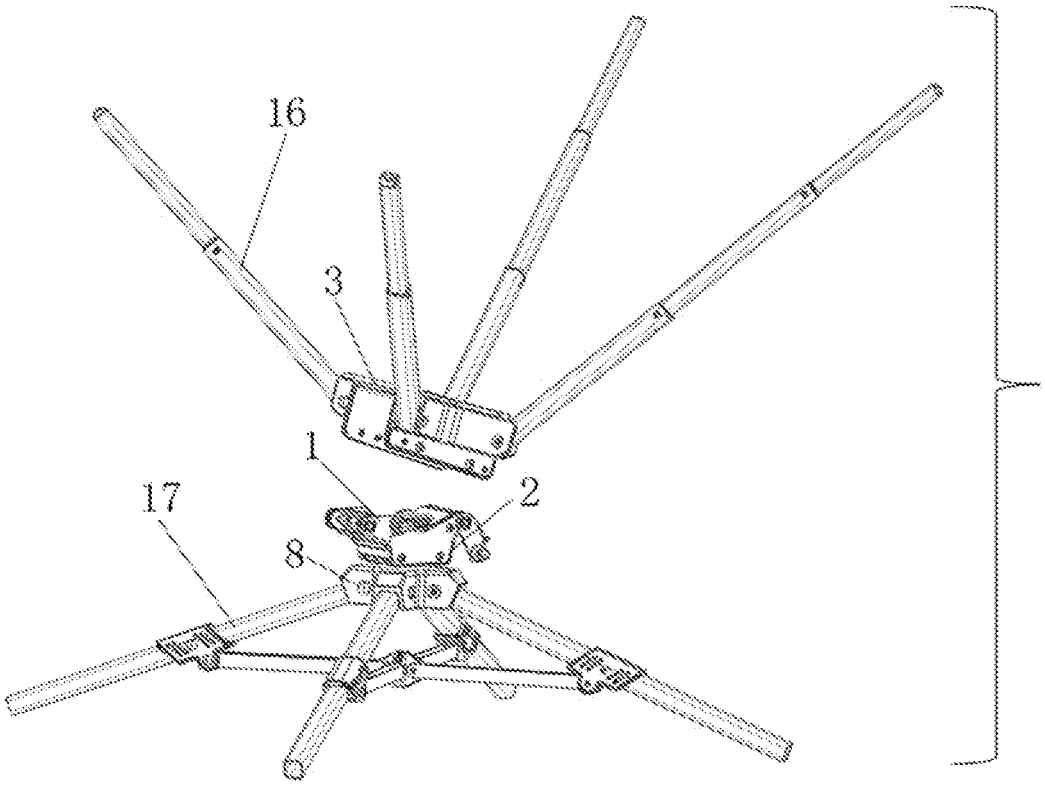
FIG. 21 is a second exploded view of the foldable chair of Embodiment 3 of the present invention.
Figure 22:
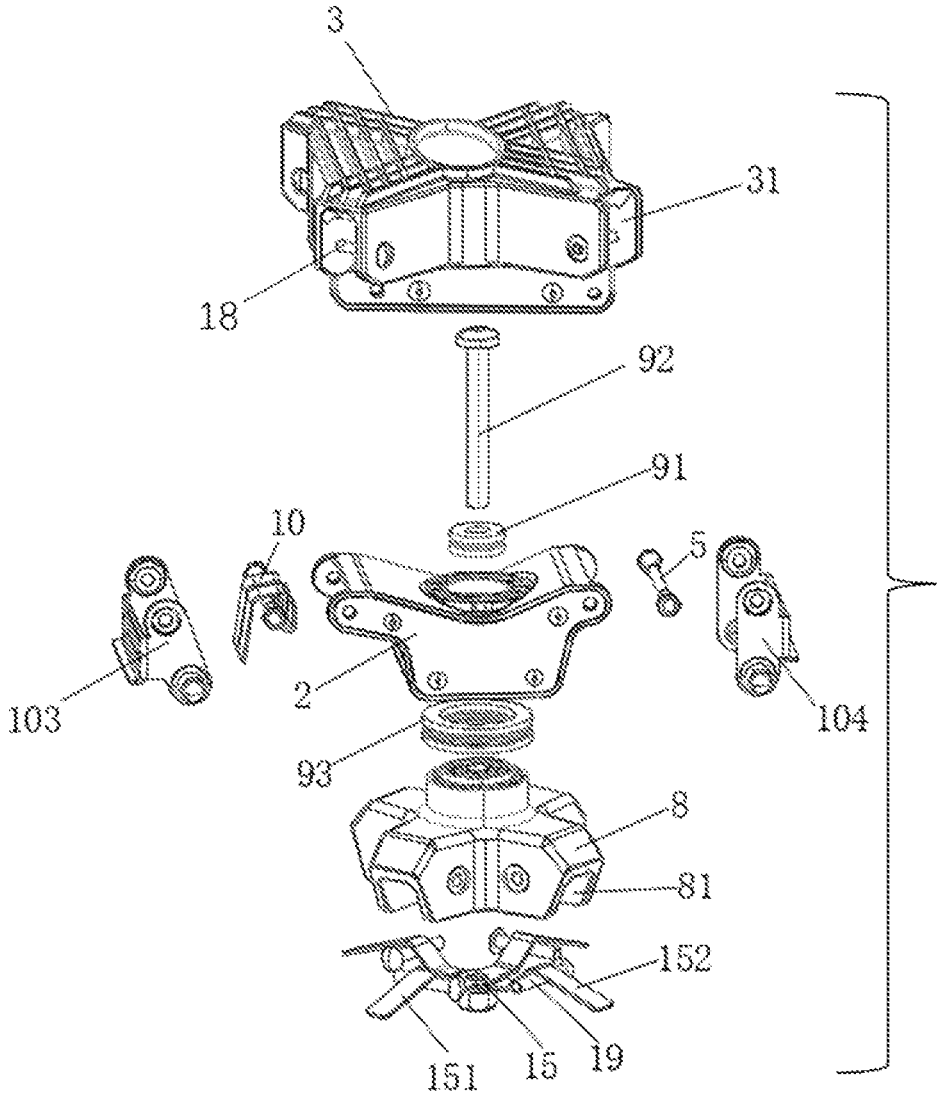
FIG. 22 is a third schematic diagram of the three-dimensional structure of the foldable chair of Embodiment 3 of the present invention.
Figure 23:
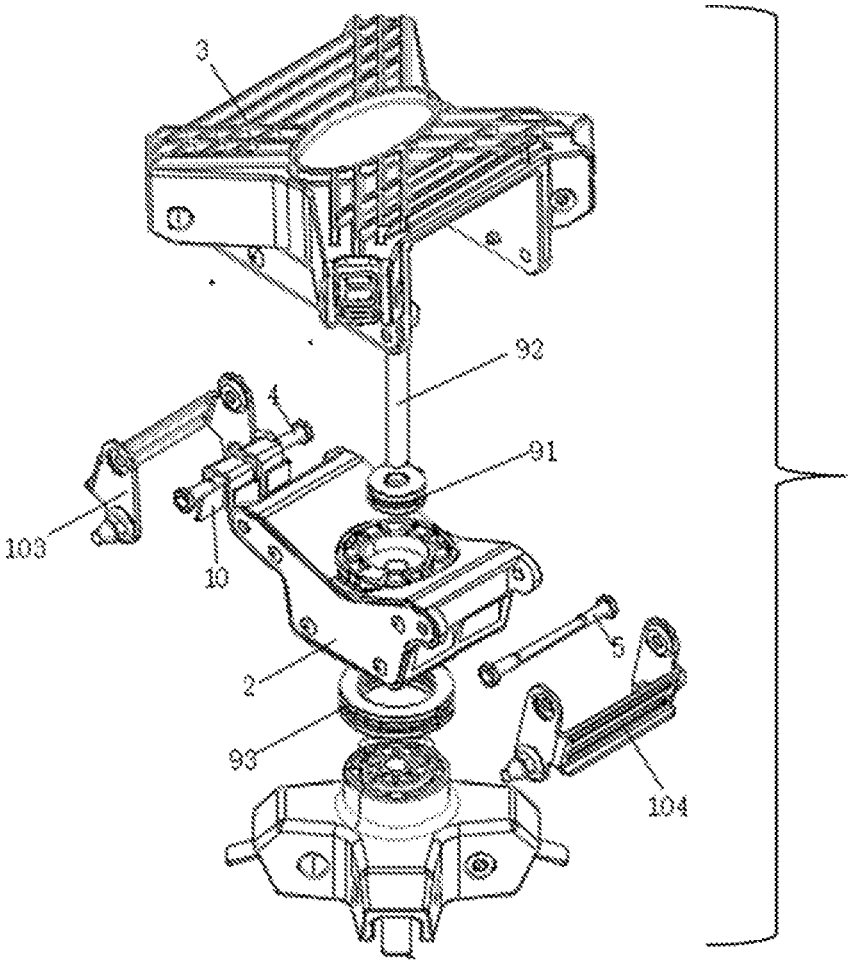
FIG. 23 is a fourth schematic diagram of the three-dimensional structure of the foldable chair of Embodiment 3 of the present invention.

When the foldable chair of Embodiment 3 is used, it can rock forward and backward, where FIG. 14 shows the maximum forward rocking amplitude, at this time the second limiting portion limits the position to which the rear rocking element rocks forward, and under the combined action of the upper assembly and the front rocking element, the upper assembly can no longer rock forward; FIG. 16 further shows the maximum backward rocking amplitude, at this time the first limiting portion limits the position to which the front rocking element rocks backward, and under the combined action of the upper assembly and the rear rocking element, the upper assembly can no longer rock backward.

It should be noted that although the above embodiments have been described in this context, the scope of patent protection of the present invention is not limited thereby. Therefore, based on the innovative concept of the present invention, the changes and modifications made to the embodiments described herein, or the equivalent structure or equivalent process transformation made by using the contents of the specification and drawings of the present invention, directly or indirectly applying the above technical solution to other related technical fields are all included in the scope of patent protection of the present invention.

What is claimed is:

1. A rotating and rocking structure, comprising an upper assembly, a base, and a rocking assembly, wherein the base is pivotally mounted on one or more rotating shafts at one or a plurality of ends of the rocking assembly, and the upper assembly is pivotally mounted on one or more rotating shafts at one or a plurality of ends of the rocking assembly;

wherein the rocking assembly comprises a front rocking element and a rear rocking element, a front end of the base is pivotally mounted on a first rotating shaft at an upper end of the front rocking element through a first pivot shaft, a front end of the upper assembly is pivotally mounted on a second rotating shaft at a lower end of the front rocking element through a first pivot member, a rear end of the base is pivotally mounted on a third rotating shaft at an upper end of the rear rocking element through a second pivot shaft, and a rear end of the upper assembly is pivotally mounted on a fourth rotating shaft at a lower end of the rear rocking element through a second pivot member;

wherein the front rocking element comprises two front rocking sheets arranged opposite to each other and a front connecting sheet vertically arranged between the two front rocking sheets, each front rocking sheet comprises a first runway-like main piece body and an irregular side piece extending from an edge of the first runway-like main piece body, the other side of the irregular side piece is connected to the front connecting sheet, and a distance from one side of the irregular side piece to the side of the first runway-like main piece body gradually increases from top to bottom.

2. The rotating and rocking structure according to claim 1, wherein the rear rocking element comprises two rear rocking sheets arranged opposite to each other and a rear connecting sheet vertically arranged between the two rear rocking sheets, each rear rocking sheet comprises a second runway-like main piece body, and the rear connecting sheet is connected to the second runway-like main piece body.

3. The rotating and rocking structure according to claim 2, wherein the base is provided with a first limiting portion for limiting a pivoting angle of the front rocking element, thereby limiting a first angle of the front rocking element pivoting relative to the base.

4. The rotating and rocking structure according to claim 3, wherein the base is provided with a second limiting portion for limiting a pivoting angle of the rear rocking element, thereby limiting a second angle of the rear rocking element pivoting relative to the base.

5. The rotating and rocking structure according to claim 3, wherein the front connecting sheet is provided with a front buffer portion corresponding to the first limiting portion, and the rear connecting sheet is provided with a rear buffer portion corresponding to the second limiting portion.

6. The rotating and rocking structure according to claim 5, wherein the base comprises two side panels arranged opposite to each other, a front end of each side panel protrudes forward to form a front protruding portion, and a rear end of each side panel protrudes backward to form a rear protruding portion, two ends of the first pivot shaft are respectively rotatably connected to the front protruding portions of the two side panels and are pivotally connected to the upper end of the front rocking element, two ends of the second pivot shaft are respectively rotatably connected to the rear protruding portions of the two side panels and are pivotally connected to the upper end of the rear rocking element, the base also comprises a bottom, the bottom and the two side panels enclose an accommodating space, a part of the bottom close to the front rocking element concaves inward to form the first limiting portion, and a part of the bottom close to the rear rocking element concaves inward to form the second limiting portion.

7. The rotating and rocking structure according to claim 6, further comprising an elastic piece, wherein one end of the elastic piece is engaged with the bottom, the elastic piece is bent around the first pivot shaft, the other end of the elastic piece is within a movement trajectory of the front connecting sheet of the front rocking element, when the front connecting sheet moves toward the first limiting portion, the front connecting sheet abuts against the other end of the elastic piece.

8. The rotating and rocking structure according to claim 1, further comprising a lower assembly, wherein the upper assembly, the base, and the lower assembly are rotatably connected via a first rotating assembly.

9. The rotating and rocking structure according to claim 8, wherein two ends of the central shaft are provided with limiting components for limiting a radial movement of the central shaft, and the limiting components are respectively engaged with the upper assembly and the lower assembly.

10. The rotating and rocking structure according to claim 1, wherein the front rocking element comprises a front rocking sheet and a front connecting sheet vertically and transversely arranged on the front rocking sheet, the front end of the base is pivotally installed on the first rotating shaft at an upper end of the front rocking sheet through the first pivot shaft, the front connecting sheet has front bending portions bent toward the base at both ends, and the front end of the upper assembly is pivotally installed on the second rotating shaft of the front bending portion of the front connecting sheet through the first pivot member; the rear rocking element comprises a rear rocking sheet and a rear connecting sheet vertically and transversely arranged on the rear rocking sheet, the rear end of the base is pivotally installed on the third rotating shaft at an upper end of the rear rocking sheet through the second pivot shaft, the rear connecting sheet has rear bending portions bent toward the base at both ends, and the rear end of the upper assembly is pivotally installed on the fourth rotating shaft of the rear bending portion of the rear connecting sheet through the second pivot member.

11. The rotating and rocking structure according to claim 10, wherein the base is provided with a first limiting portion for limiting a pivoting angle of the front rocking element, thereby limiting a first angle of the front rocking element pivoting relative to the base; the base is provided with a second limiting portion for limiting a pivoting angle of the rear rocking element, thereby limiting a second angle of the rear rocking element pivoting relative to the base.

12. The rotating and rocking structure according to claim 11, wherein the base comprises two side panels arranged opposite to each other, a front end of each side panel protrudes forward to form a front protruding portion, and a rear end of each side panel protrudes backward to form a rear protruding portion, two ends of the first pivot shaft are respectively rotatably connected to the front protruding portions of the two side panels and are pivotally connected to the upper end of the front rocking element, two ends of the second pivot shaft are respectively rotatably connected to the rear protruding portions of the two side panels and are pivotally connected to the upper end of the rear rocking element, the base also comprises a bottom, the bottom and the two side panels enclose an accommodating space, a part of the bottom close to the front rocking element concaves inward to form the first limiting portion, and a part of the bottom close to the rear rocking element concaves inward to form the second limiting portion, the base also comprises a cover plate, and the cover plate is provided with a concave surface.

13. The rotating and rocking structure according to claim 12, further comprising an elastic piece, wherein one end of the elastic piece is engaged with the bottom, the elastic piece is bent around the first pivot shaft, the other end of the elastic piece is within a movement trajectory of the front connecting sheet of the front rocking element, when the front connecting sheet moves toward the first limiting portion, the front connecting sheet abuts against the other end of the elastic piece.

14. The rotating and rocking structure according to claim 12, wherein the bottom is provided with a front fallback space facilitating a rotation of the front rocking sheet and a rear fallback space facilitating a rotation of the rear rocking sheet.

15. A rotating and rocking structure, comprising an upper assembly, a lower assembly, a base, and a rocking assembly, wherein the base is pivotally mounted on one or more rotating shafts at one or a plurality of ends of the rocking assembly, the upper assembly is pivotally mounted on one or more rotating shafts at one or a plurality of ends of the rocking assembly, and the upper assembly, the base, and the lower assembly are rotatably connected via a first rotating assembly; wherein the first rotating assembly includes a first bearing, a central shaft, and a second bearing, the central shaft passes through the upper assembly, the base, and the lower assembly, the first bearing is sleeved on the central shaft and arranged between the upper assembly and the base, and the second bearing is sleeved on the central shaft and arranged between the base and the lower assembly.

16. A foldable chair having a rotating and rocking structure, comprising a plurality of support arms and a plurality of support legs, wherein the rotating and rocking structure comprises an upper assembly, a lower assembly, a base, and a rocking assembly, wherein the base is pivotally mounted on one or more rotating shafts at one or a plurality of ends of the rocking assembly, the upper assembly is pivotally mounted on one or more rotating shafts at one or a plurality of ends of the rocking assembly, and the upper assembly, the base, and the lower assembly are rotatably connected via a first rotating assembly; wherein the upper assembly is provided with a plurality of upper receiving grooves for receiving the plurality of support arms, and the lower assembly is provided with a plurality of lower receiving grooves for receiving the plurality of support legs, the plurality of support arms are rotatably connected in the plurality of upper receiving grooves of the upper assembly through first rotary shafts, the lower assembly also comprises an elastic piece assembly, the elastic piece assembly comprises a first elastic piece and a second elastic piece, the first elastic piece and the second elastic piece are cross-stacked and received in a divergent state in the plurality of lower receiving grooves of the lower assembly, the plurality of support legs are rotatably connected in the plurality of lower receiving grooves of the lower assembly through second rotary shafts, the first elastic piece and the second elastic piece go across the second rotary shafts and ends thereof are located on inner walls of the plurality of support legs, under an action of the first elastic piece and the second elastic piece, the plurality of support leg are kept in an outwardly stretched state with the second rotary shafts as rotating shafts.

17. The foldable chair according to claim 16, wherein each of the plurality of support legs is a retractable support leg, and each of the plurality of support arms is a retractable support arm.

* * * * *